US005560298A

United States Patent [19]

Krokolinski et al.

[11] Patent Number: 5,560,298

[45] Date of Patent: Oct. 1, 1996

[54] METHOD AND APPARATUS FOR MOUNTING A FLEXIBLE PLATE

[75] Inventors: Peter Krokolinski, Worms; Helmut Puschnerat, Wachenheim, both of Germany

[73] Assignee: Koenig & Bauer-Albert Aktiengesellschaft, Wurzburg, Germany

[21] Appl. No.: 552,988

[22] Filed: Nov. 3, 1995

[30] Foreign Application Priority Data

Nov. 5, 1994 [DE] Germany ..... 44 39 616.3
Dec. 29, 1994 [DE] Germany ..... 44 47 088.6

[51] Int. Cl.[6] ..... B41C 13/14

[52] U.S. Cl. ..... 101/486; 101/477; 101/415.1

[58] Field of Search ..... 101/415.1, 477, 101/408, 409, 486

[56] References Cited

FOREIGN PATENT DOCUMENTS

| | | |
|---|---|---|
| 0516260 | 12/1992 | European Pat. Off. . |
| 4035664 | 6/1991 | Germany . |
| 4219822 | 12/1993 | Germany . |
| 518176 | 1/1972 | Switzerland . |

*Primary Examiner*—Eugene H. Eickholt
*Attorney, Agent, or Firm*—Jones, Tullar & Cooper, P.C.

[57] ABSTRACT

A fastening leg of a fastening edge of a trailing end of a flexible plate is inserted into a cooperating mounting slit in a cylinder by utilization of a plate trailing end inserting device. The trailing end of the flexible plate is caused to arc outwardly prior to insertion of the fastening leg into the mounting slot. This causes the effective length of the plate to be shortened.

16 Claims, 3 Drawing Sheets

METHOD AND APPARATUS FOR MOUNTING A FLEXIBLE PLATE

FIELD OF THE INVENTION

The present invention is directed generally to a method and apparatus for mounting a flexible plate. More particularly, the present invention is directed to a method and apparatus for mounting a flexible plate on a cylinder. Most specifically, the present invention is directed to a method and apparatus for mounting a flexible plate provided with fastening or mounting edges on a cylinder of a rotary printing press. The cylinder is provided with plate receiving mounting slits and the fastening edge on the flexible plate are bent at angles which correspond to the angle or angles of the plate end mounting slits. A fastening edge on the leading portion of the flexible plate preferably has an acute angle while the fastening edge on the trailing portion of the plate preferably has an obtuse angle. After the fastening edge on the leading portion of the plate has been inserted into its mounting slit, the plate is rolled onto the cylinder. A plate trailing end inserting device is usable to place the bent trailing plate end into its appropriate mounting slit.

DESCRIPTION OF THE PRIOR ART

It is known generally to utilize flexible plates in rotary printing presses. These plates typically are flexible printing plates but may also be plates provided with a resilient surface covering and thus can be flexible blanket plates. Such flexible plates are mounted on their receiving cylinders by fastening of the plate ends to the cylinder. Various plate end clamps, hooks and other fastening arrangements have been utilized to secure the ends of the flexible plate onto the cylinder.

One prior art method and apparatus for mounting and removing a flexible printing plate from a plate cylinder of a rotary printing press is shown in German Patent Publication DE 42 19 822 A1. This prior art method and apparatus is usable with a printing plate that has an acutely angled nesting or fastening trailing edge that is preferably right-angled. This right-angled plate trailing end fastening edge is pressed into a mounting or fastening slit in the cylinder by a pressure roller.

The limitation of this prior art device is that when the nesting or fastening trailing edge is pressed into the mounting or fastening slit by a pressure roller, the functional and operable dependability of the printing press cylinder to which the plate has been fastened depends on the accuracy and dimensional stability of the nesting or fastening edges. If this insertion is not properly performed, the flexible printing plate may come loose and the operation of the printing machine must be stopped.

It will thus be seen that a need exists for a device and for a procedure for its use which overcomes the limitations of the prior art. The method and apparatus for mounting a flexible plate provides such a device and a procedure for its use and is a significant advantage over the prior art.

SUMMARY OF THE INVENTION

It is an object of the present invention to provide a method and an apparatus for mounting a flexible plate.

Another object of the present invention is to provide a method and an apparatus for mounting a flexible plate on a cylinder.

A further object of the present invention is to provide a method and apparatus for mounting a flexible plate provided with fastening edges on a cylinder of a rotary printing press.

Still another object of the present invention is to provide a method and apparatus for mounting a flexible plate on a cylinder provided with mounting or fastening slits.

Even a further object of the present invention is to provide a method and apparatus for mounting a flexible plate having a plate trailing end fastening edge which is equal to or greater than 90°.

As will be discussed in detail in the description of the preferred embodiment which is presented subsequently, the flexible printing plate in accordance with the present invention is provided with leading and trailing end portions both of which are provided with fastening or mounting edges. These edges are insertable into fastening or mounting slits or into a single fastening slit provided on the peripheral surface of the cylinder. The nesting or fastening edge at the trailing end of the plate is preferably greater than 90°. After the nesting or fastening edge at the leading end of the plate has been inserted into the slit, the plate is rolled onto the cylinder. After a certain portion of the plate has been rolled onto the cylinder, a plate trailing end inserting device is moved into position against the cylinder. The plate trailing end fastening edge is engaged by this device and the section of the plate not yet in contact with the cylinder is bowed slightly outwardly. A chord length between the point of separation of the plate from the cylinder to the free end of the fastening leg of the trailing plate end corresponds to a chord length between the separating point and the fastening or mounting slit. The plate trailing end fastening edge is then pushed into the slit by the trailing end inserting device which uses an inserting slider whose angular orientation is the same as the mounting slit in the cylinder.

The method and apparatus for fastening a flexible plate to a cylinder in accordance with the present invention overcomes the limitations of the prior art. The dependable insertion of a nesting or fastening edge at the trailing end of a printing plate into even the narrowest mounting slits in plate cylinders of a rotary printing press is assured by the method of the present invention and by usage of the associated plate trailing end insertion device. With plates having nesting or fastening edges and particularly with trailing end fastening edges whose opening angle $\beta$ is equal to or greater than 90°, a secure mounting of the fastening edge in the mounting slit is made possible in a manner that had not been possible by use of the prior art pressure rollers. It is also possible in accordance with the present invention to mount plates whose nesting edge at the plate trailing end is not located in the area of a slit fastening when the plate has been applied by rolling. This is particularly the case when the opening angle $\beta$ of the plate trailing end fastening edge is obtuse.

The method and apparatus for mounting a flexible plate to a plate cylinder of a rotary printing press in accordance with the present invention overcomes the limitations of the prior art. It is a substantial advance in the art.

BRIEF DESCRIPTION OF THE DRAWINGS

While the novel features of the method and apparatus for mounting a flexible plate in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
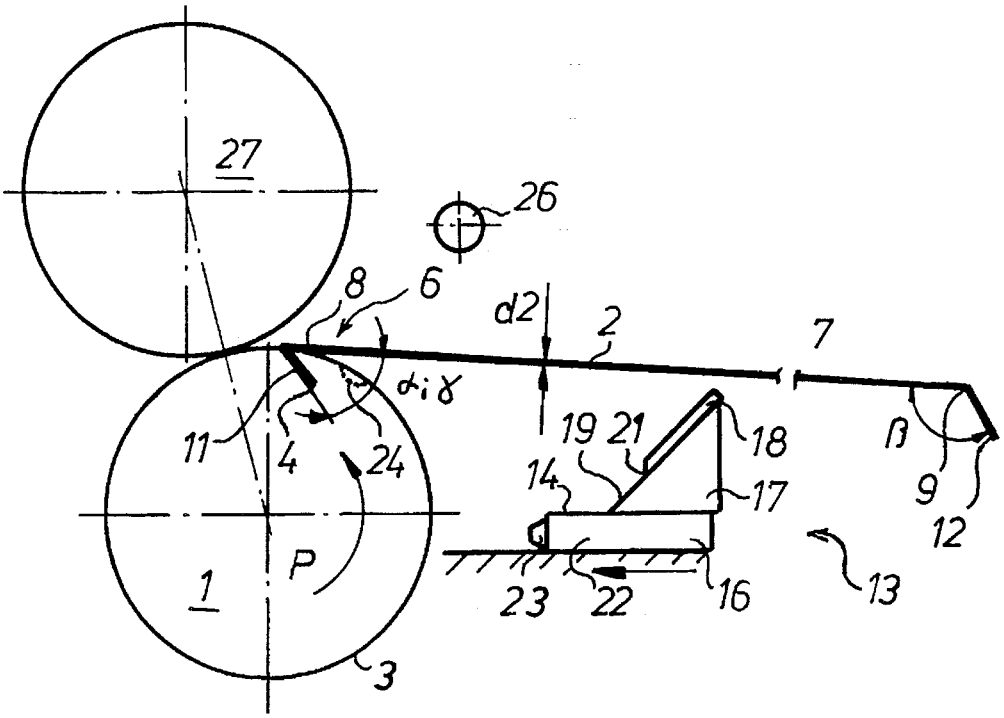
FIG. 1 is a schematic side elevation view of a cylinder with a flexible plate whose leading end has been hung in a mounting slit and with a plate trailing end insertion device in accordance with the present invention in a rest position.

Referring initially to FIG. 1, there may be seen a preferred embodiment of a method and an apparatus for accomplishing the mounting of a flexible plate to a cylinder in accordance with the present invention. As may be seen in FIG. 1, as well as in FIGS. 2–5, a cylinder 1 of a rotary printing press is provided with plate end mounting or fastening slits 4, which extend axially along the periphery of the cylinder 1 and radially from a surface 3 of the cylinder 1 into the interior of the cylinder 1. These slits 4 are intended to secure fastening edges of a flexible printing plate 2. The plates 2 which have a thickness "d2", of, for example 0.3 mm, are preferably printing plates. However it is also possible to use plates 2 with, for example, rubber blankets applied to them. The plate 2 is provided at its front or leading end 6 and at its trailing end 7 with nesting or fastening edges 8 and 9, respectively. The nesting or fastening edges 8 and 9 are formed by leading and trailing nesting or fastening legs 11 and 12, which form an angle $\alpha$ of, for example 45°, at the front or leading end 6, and an angle $\alpha$ of, for example 135°, at the trailing end 7, with respect to the level plate 2. The angle $\beta$ at the front or leading end 6 is preferably acute, while the angle $\beta$ at the trailing end 7 is preferably obtuse.

In the present example, the mounting slit 4 is embodied as a slit which extends axially over a length of the cylinder 1 and which projects from the surface 3 of the cylinder 1 into the interior of the cylinder 1 and whose width "b4" corresponds to at least twice the thickness "d2" of the plate 2. This slit 4 thus receives both the nesting or fastening edges 8 and 9 at the front end 6 and trailing end 7 of the plate 2. It is of course also possible to use slits 4 which are separate for the front end 6 and the trailing end 7. It is further possible to provide several mounting slits 4 to receive several plates 2 on the circumference or along the length of the cylinder 1. The mounting slit 4 is preferably inclined at an angle $\gamma$, of, for example 45°, with respect to a peripheral surface 3 of the cylinder 1. The angles $\alpha$ and $\beta$ of the fastening edges 8 and 9 of the plate 2 are adapted to the angle $\gamma$ of the mounting slit 4.

A plate trailing end insertion device 13 for use in the insertion of the nesting or fastening edge 9 at the trailing end 7 of the plate 2 is associated with the cylinder 1. This insertion device 13 essentially consists of a cross arm 16, which is provided with a first guide face 14; a feed carriage 17, and an inserting slider 18. The guide face 14 is embodied as a flat plate, which has a first direction that extends axially along the length of the cylinder 1, and which has a second direction that extends radially with respect to the cylinder 1. The feed carriage 17 is movably disposed on this flat guide face 14, and is movable in the radial direction with respect to the cylinder 1. The feed carriage 14 has a second flat guide face 19, whose first direction also extends axially along the length of the cylinder 1 and whose second direction extends parallel to the position of the mounting slit 4 of the cylinder 1, when the cylinder 1 is placed in the plate trailing end insertion position "E", as shown in FIGS. 2–5. The inserting slider 18 is disposed so that it is movable along this second guide face 19 of the feed carriage 17. This inserting slider 18 is embodied as a plate which is parallel to feed carriage 17 and whose front 21 facing the cylinder 1 is formed slanted, for example at an angle of 45°, so that the front 21 extends approximately perpendicular with respect to the first guide face 14 of the feed cylinder 17. The inserting slider 18 is movable in the direction toward the guide face 14 until the front 21 of the inserting slider 18 reaches the guide face 14 of the feed carriage 17.

The movements of the feed carriage 17 and of the inserting slider 18 can, for example, be executed by means of pneumatic cylinders, not shown. The entire device 13 can be moved from a working position close to the cylinder 1, as depicted in FIGS. 2 to 5 into a position of rest remote from the cylinder 1, as shown in FIG. 1. Linear guides, fixed on the frame and not specifically shown in the drawings, can be used for this, on which the inserting device 13 may be movably disposed by means of actuator drives, such as, for example, pneumatic cylinders.

A stop bolt 22, which is radially movable but which is otherwise fixed in place, is provided on the cross arm 16 and is used for assuring an exact insertion position "E" of the cylinder 1 with respect to the inserting device 13. On its end 23 facing the cylinder 1, the stop bolt 22 is conical in shape. This conical end 23 cooperates with a recess 24 on the cylinder 1, with recess 24 also being generally conical and being adapted to receive the end 23 of the stop bolt 22. It is possible, for example, to fasten the stop bolt 22 on the cross arm 16 of the device 13. Because of the movement of the inserting device 13 from the rest position into the working position, the stop bolt 22 engages the recess 24 of the cylinder 1 located outside of the plate width and in this way exactly defines the insertion position "E" of the cylinder 1 with respect to the inserting device 13.

A rotatable pressure roller 26, that is positioned to extend axially along the cylinder 1, is disposed above the plate trailing end inserting device 13. This pressure roller 26 is structured to be placed against or moved away from the surface 3 of cylinder 1. The movement for placing pressure roller 26 against, and removing it from, the surface 3 of cylinder 1 may take place by means of a pneumatic cylinder, for example (not shown). The pressure roller 26 can be provided with a soft cover, for example of caoutchouc, and can be made in one or several pieces. It is also possible to use other pressing or holding elements in place of the pressure roller 26.

Figure 2:
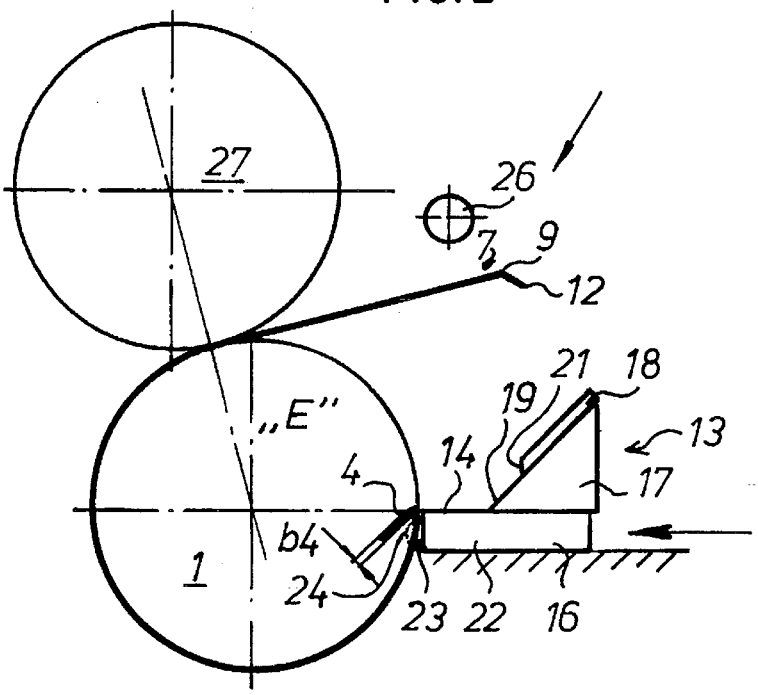
FIG. 2 shows the plate cylinder with the insertion device in its working position.

The process for accomplishing the mounting of a flexible plate 2 to the surface 3 of a cylinder 1 in accordance with the present invention takes place as follows. The cylinder 1 is placed into a mounting position P, as shown in FIG. 1. A press operator or a mechanical device hooks the nesting or fastening edge 8 at the front end 6 of the plate 2 into the mounting slit 4, and the cylinder 1 is caused to rotate in the production direction "P". The cylinder 1 cooperates, for example, with a second cylinder 27, for example a rubber cylinder 27, wherein the cylinder 27 rolls the plate 2 up on the cylinder 1o it is also possible to roll up the plate 2 on the cylinder 1 by means of the pressure roller 26. The cylinder 1 rotates until it has reached the insertion position "E" and stops, as shown in FIG. 2. The pressure roller 26 has been placed against cylinder 1 and thereby presses the plate 2 on the cylinder 1. Now the stop bolt 22 on the inserting device 13 is brought into the recess 24 of the cylinder 1 for exact positioning of the cylinder 1 and in this way the location of cylinder 1 is exactly adjusted. As depicted in the present embodiment, this can be performed with the movement of the inserting device 13 from its rest position into its working position. However, the two movements can also be performed independently of each other. The guide face 14 of the inserting device 13 will now be located adjacent the cylinder 1 and in the area of the mounting slit 4 directly and radially adjacent the surface 3 of the cylinder 1.

Figure 3:
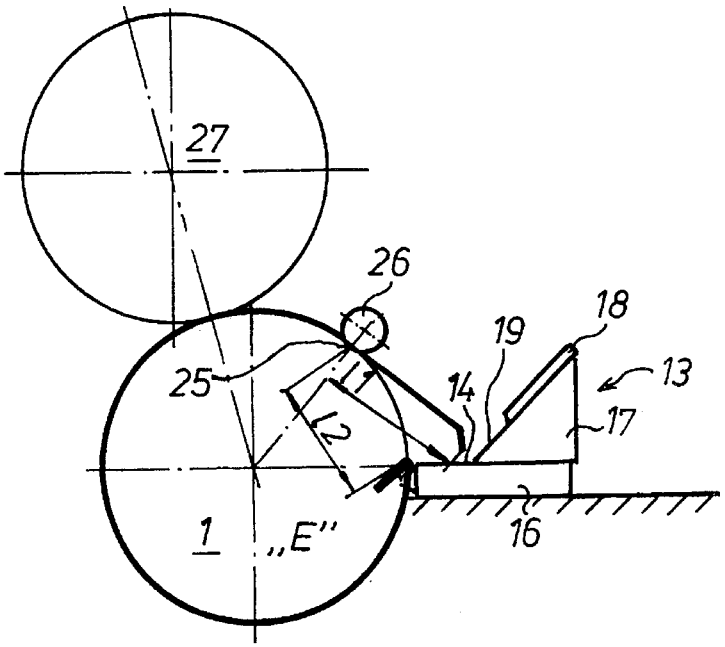
FIG. 3 shows the plate cylinder with the pressure roller applied.

The trailing end 7 of the flexible plate 2, which has not yet been rolled onto the surface 3 of the cylinder 1 extends generally longitudinally away from the surface 3, as is shown in FIG. 3. The point of tangency of the plate 2 with the cylinder 1 is at a separation line 25 which passes through the axes of rotation of the cylinder 1 and of the pressure roller 26. This separation line 25 is generally perpendicular to the trailing end 7 of the plate 2 at the point of tangency. In this position of the cylinder 1 and the plate trailing end inserting device 13, the nesting or fastening edge 9 of the trailing end 7 of the flexible plate 2 is now situated so that it can be engaged by the inserting device 13. Instead of the pressure roller 26 engaging the plate 2, it would be possible for the second cylinder 27 to apply this force. In this case, the separating line 25 would be determined by the cylinder 1 and the second cylinder 27.

Figure 4:
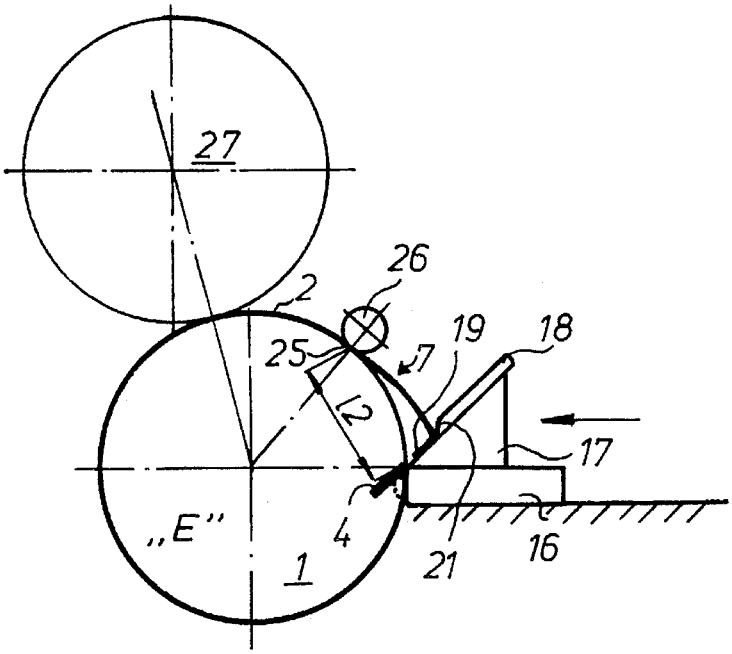
FIG. 4 shows the plate cylinder with the insertion device having its feed carriage moved adjacent the cylinder.

Once the nesting or fastening edge 9 of the trailing end 7 of the flexible plate 2 is situated as depicted in FIG. 3, the feed carriage 17 will be moved inwardly toward the surface 3 of the cylinder 1, as shown in FIG. 4. This moves the second flat guide face 19 into alignment with the plate end mounting slit 4. The nesting or fastening leg 12 of the nesting or fastening edge 9 of the plate trailing end 7 is guided along the first guide face 14 by the movement of the feed carriage 17. This causes the free portion of the plate 2; i.e. that portion between the separation line 25 and the nesting or fastening leg 12 to bow outwardly in a prestressed arc. This arc is located between the pressure roller 26 and the feed carriage 17. The distance between the separating line 25 of the pressure roller 26 to the end of the nesting or fastening leg 12 of the nesting or fastening edge 9 of the flexible plate 2 is thus shortened. This shortening deformation of the plate 2 is preferably accomplished in an elastic manner. A chord length 11 between the separation line 25 and the end 12 of the nesting or fastening leg 9 of the trailing end 7 of the flexible plate 2 is adapted to a chord length 12 between the separation line 25 and the mounting slit 4. In the area of the mounting slit 4, the nesting leg 12 of the nesting or fastening edge 9 of the trailing end 7 of the flexible plate 2 is now located on the level of the surface 3 of the cylinder 1.

Figure 5:
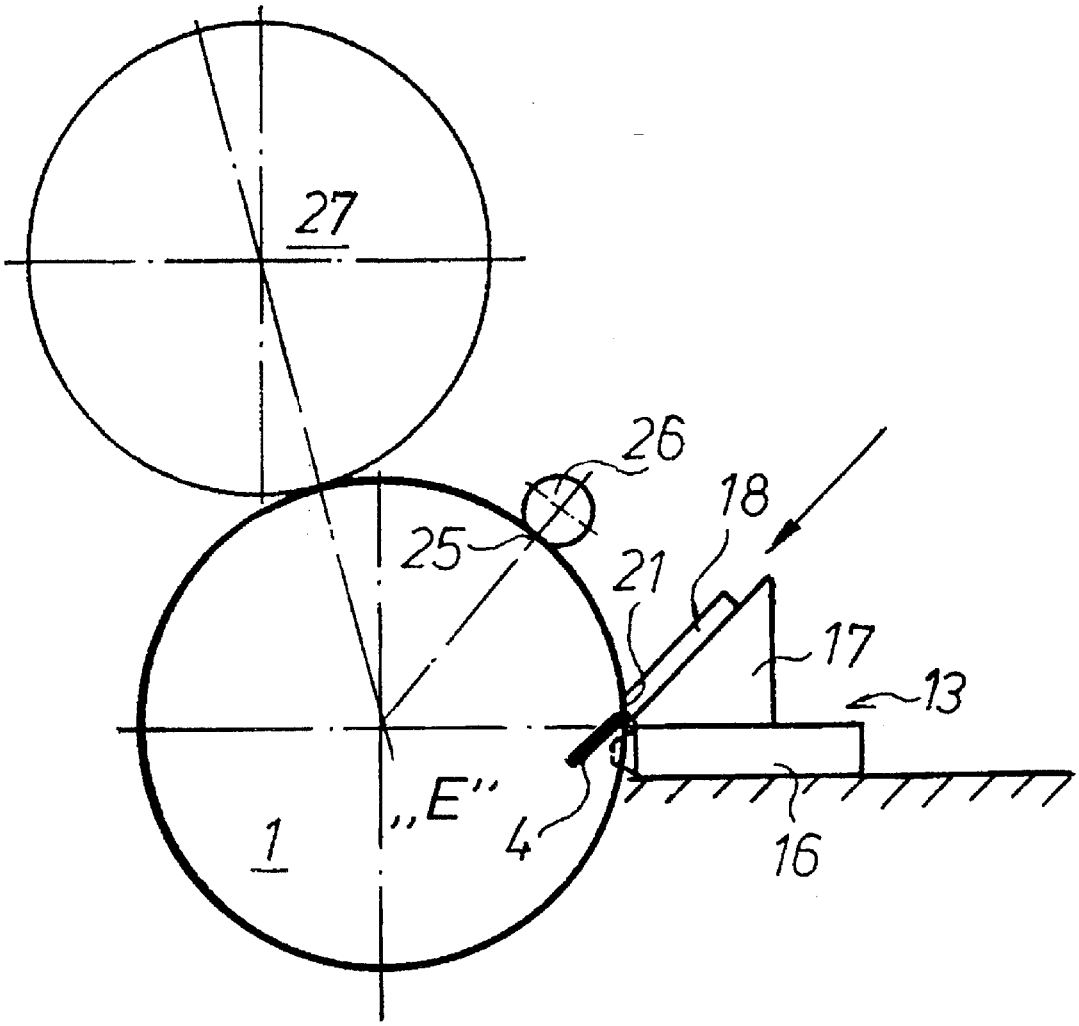
FIG. 5 shows the insertion device having its plate end inserting slider moved into its plate end inserting position adjacent the cylinder.

As may now be seen by referring to FIGS. 4 and 5, the inserting slider 18 will now move down the ramp face 19 of the feed carriage toward the cylinder 1. The inclined front end 21 of the inserting slider 18 engages the fastening edge 9 of the trailing end 7 of the flexible plate 2 and pushes it into the mounting slit 4. Once the plate trailing end mounting edge 9 has been inserted into the mounting slit 4, the inserting slider 18 is moved back up the ramp surface 17, and the inserting device 13 is moved away from the cylinder 1 to thereby separate the cylinder 1 and the stop bolt 22. This terminates the process of mounting the flexible plate 2 on the surface 3 of the cylinder 1.

Instead of the radial sliding movement of the inserting device 13 with respect to the cylinder 1, as depicted in FIGS. 1–5, the inserting device 13 could be moved in a pivotable manner from the cylinder 1 toward the end 7 of the plate 2. This would also accomplish the desired result of grasping the nesting or fastening edge 12 of the trailing end 7 of the plate 2. In another embodiment, which is also not shown in the drawings, it would also be possible to move the inserting device 13, together with the grasped trailing end 7 of the plate 2 into the area of the mounting slit 4, following the grasping of the end 7 of the plate 2.

While a preferred embodiment of a method and apparatus for mounting a flexible plate on a cylinder of a rotary printing press in accordance with the present invention has been set forth fully and completely hereinabove, it will be apparent to one of skill in the art that a number of changes in, for example, the overall sizes of the cylinders, the material used for the flexible plate, the drive assembly for the cylinder and the like could be made without departing from the true spirit and scope of the present invention which is accordingly to be limited only by the following claims.

What is claimed is:

1. A method of mounting a flexible plate on a cylinder including:

providing said flexible plate having a plate leading end with a leading end fastening edge and a plate trailing end with a trailing end fastening edge, said trailing end fastening edge having an opening angle with respect to said flexible plate of at least 90°;

locating a plate fastening edge receiving mounting slit on a peripheral surface of said cylinder;

inserting said plate leading end fastening edge in said mounting slit;

rolling said plate partially onto said peripheral surface of said cylinder;

defining a separating line where a yet to be rolled on portion of said plate is free from said cylinder, said yet to be rolled on portion of said plate extending from said separating line to said plate trailing end fastening edge having a first chord length;

bending said yet to be rolled on portion of said plate and shortening said first chord length and making said first chord length equal to a second chord length from said separating line to said mounting slit; and moving said plate trailing end fastening edge into said mounting slit.

2. The method of claim 1 further including providing a plate trailing end inserting device and engaging said plate trailing end fastening edge with said inserting device and moving said trailing end fastening edge into said mounting slit in a direction corresponding to an inclination angle of said mounting slit.

3. The method of claim 1 further including bending said plate elastically.

4. The method of claim 1 further including providing a pressure roller and using said pressure roller to roll said plate onto said cylinder.

5. The method of claim 1 further including providing a second cylinder and using said second cylinder to roll said plate onto said cylinder.

6. The method of claim 4 further including holding said partially rolled on plate on said cylinder with said pressure roller.

7. The method of claim 5 further including holding said partially rolled on plate on said cylinder with said second cylinder.

8. The method of claim 2 further including providing a pressure roller and conveying said trailing end fastening edge into engagement with said inserting device by using said pressure roller.

9. The method of claim 2 further including moving said inserting device toward said yet to be rolled on portion of said plate.

10. The method of claim 9 including moving said inserting device and said trailing end fastening edge toward said mounting slit.

11. A device for mounting a flexible plate on cylinder comprising:

a plate leading end with a leading end fastening edge and a plate trailing end with a trailing end fastening edge on said plate;

a plate leading and trailing end fastening edge receiving mounting slit on a peripheral surface of said cylinder; and a plate end inserting device having a guide face, a feed carriage, and an inserting slider, said guide face being disposed extending radially and axially with respect to said cylinder, said feed carriage being movable along said guide face, and said inserting slider being disposed to be movable in a direction of said mounting slit in said cylinder.

12. The device of claim 11 wherein said inserting slider is movable on said feed carriage.

13. The device in accordance with claim 11 wherein said inserting slider has a front and further wherein said front of said inserting slider is generally perpendicular to said guide face of said inserting device.

14. The device of claim 11 further including a stop bolt on said inserting device and a recess on said peripheral surface of said cylinder, said stop bolt being receivable in said recess.

15. The device of claim 11 wherein said inserting device is movable radially with respect to said cylinder.

16. The device of claim 11 wherein said inserting device is pivotable around said cylinder.

* * * * *